US006106701A

United States Patent [19]

Hart

[11] Patent Number: 6,106,701

[45] **Date of Patent: *Aug. 22, 2000**

[54] DEASPHALTING PROCESS

[75] Inventor: Paul R. Hart, The Woodlands, Tex.

[73] Assignee: Betzdearborn Inc., Trevose, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 09/139,158

[22] Filed: Aug. 25, 1998

[51] Int. Cl.[7] ..... C10C 3/00

[52] U.S. Cl. ..... 208/309; 208/39; 208/44; 208/45

[58] Field of Search ..... 208/309, 39, 45

[56] References Cited

U.S. PATENT DOCUMENTS

| | | | |
|---|---|---|---|
| 2,952,620 | 9/1960 | Wade . | |
| 3,830,732 | 8/1974 | Gatsis . | |
| 4,407,707 | 10/1983 | Merchant, Jr. et al. . | |
| 4,500,416 | 2/1985 | Van Dongen et al. . | |
| 4,502,950 | 3/1985 | Ikematsu et al. . | |
| 4,514,287 | 4/1985 | Ikematsu et al. . | |
| 4,522,710 | 6/1985 | Achia et al. . | |
| 4,525,269 | 6/1985 | Ikematsu et al. . | |
| 4,539,099 | 9/1985 | Merchant et al. . | |
| 4,592,832 | 6/1986 | Bristow et al. . | |
| 4,634,520 | 1/1987 | Angelov et al. . | |
| 4,673,485 | 6/1987 | Bristow et al. . | |
| 4,747,936 | 5/1988 | Penning . | |
| 4,810,367 | 3/1989 | Chombart et al. . | |
| 4,810,819 | 3/1989 | Chombart et al. | 208/309 |
| 4,889,618 | 12/1989 | Tyson, Jr. et al. . | |
| 4,915,819 | 4/1990 | Chirnos et al. | 208/309 |
| 4,968,449 | 11/1990 | Stephenson . | |
| 5,013,427 | 5/1991 | Mosby et al. . | |
| 5,124,024 | 6/1992 | Krzywichi et al. . | |
| 5,124,025 | 6/1992 | Kolstad et al. . | |
| 5,124,026 | 6/1992 | Taylor et al. . | |
| 5,124,027 | 6/1992 | Beaton et al. . | |
| 5,145,574 | 9/1992 | Hedrik . | |
| 5,178,750 | 1/1993 | Mead . | |
| 5,178,875 | 1/1993 | Lenk et al. . | |
| 5,182,024 | 1/1993 | Chen . | |
| 5,228,978 | 7/1993 | Taylor et al. . | |
| 5,242,578 | 9/1993 | Taylor et al. . | |
| 5,258,117 | 11/1993 | Kolstad et al. . | |
| 5,312,543 | 5/1994 | Taylor et al. . | |
| 5,401,439 | 3/1995 | Elfers et al. . | |
| 5,476,988 | 12/1995 | Hart et al. . | |
| 5,481,059 | 1/1996 | Brock et al. . | |
| 5,593,572 | 1/1997 | Hart . | |
| 5,681,451 | 10/1997 | Hart . | |
| 5,750,052 | 5/1998 | Hart . | |
| 5,921,911 | 7/1999 | Hart . | |

*Primary Examiner*—Helane Myers
*Attorney, Agent, or Firm*—Greenblum & Bernstein P.L.C.

[57] ABSTRACT

Disclosed are methods for improving the separation of resins and asphaltenes from each other and a base residuum during alkane deasphalting by adding a phase separation accelerator to the residuum. The phase separation accelerators include alkyl and alkylaryl alkoxylates, alkylaryl sulfonates, and hetero-atom punctuated fatty polymers.

15 Claims, No Drawings

DEASPHALTING PROCESS

FIELD OF THE INVENTION

The present invention provides for methods for improving the separation of resins from asphaltenes during a deasphalting process. More particularly, the present invention provides for methods for improving this separation during alkane deasphalting using an extraction aid.

BACKGROUND OF THE INVENTION

Naturally occurring hydrocarbons often contain a portion of comparatively high molecular weight polynuclear aromatic, heteroatom (i.e. other than carbon and hydrogen, e.g. sulphur, oxygen, nitrogen and various metals) containing compounds, generally referred to collectively as asphaltenes. Such asphaltenes as contained in the hydrocarbons are harmful in remarkably decreasing the activity of hydrogenation or cracking catalysts, for example, due to the metals included in the asphaltene. Associated with the asphaltenes is a far larger fraction of similar compounds, known collectively as resins, which differ from the asphaltenes primarily in being lower molecular weight, less polynuclear aromatic, more soluble in aliphatic hydrocarbon, and far lower in harmful metal content. For this reason, it is often necessary to remove the asphaltenes, but not the resins, from asphaltene containing hydrocarbons, or to remove the resins separately.

The removal of the asphaltenes from asphaltene containing hydrocarbons is generally by a solvent deasphalting method, comprising the use of low boiling, liquid or supercritical paraffinic hydrocarbons, such as propane, butane or light naphtha, to precipitate the less soluble asphaltenes from the more soluble resins and oils, and then separate and remove them from the supernatent on the basis of their greater density, typically using gravitational settling.

The solvent may be selected from the group comprising saturated, aliphatic hydrocarbons having from 2 to 20 carbon atoms, alone or mixed; distributions of hydrocarbons from distillation cuts, with hydrocarbon chain lengths from 2 to 20 carbon atoms; and mixtures of all of the hydrocarbons cited above.

Deasphalting can be carried out in a single stage, in which case an oil phase and an asphaltic phase are obtained, the former containing both the oils and the resins. To recover the separated asphaltenes, all dissolved and dispersed alkane solvent must be removed, generally by letting down the pressure to convert the liquid or supercritical alkane to a gaseous or subcritical state. Entrained alkane droplets left in the asphaltenes by incomplete separation causes increased, often uncontrollable foaming during solvent removal. This causes contamination of the solvent and subsequent fouling of the equipment.

Deasphalting can also be carried out in two stages, using different solvents and/or different operating conditions, such as temperature, pressure or dilution, in each of the two stages. In the two-stage process, the oils and the resins in the single stage supernatent are separated from each other in a second stage. Thus any precipitated but unseparated asphaltenes in the supernatent going to the second stage contaminates and degrades the quality of the recovered resins.

The recovered asphaltenes are used to make a hard pitch that can be ground and used as a solid fuel, or to make an asphalt binder that can be mixed with aggregate and used to pave roads. Resins and oils can be carried into the asphaltenes with the entained solvent and left behind when the solvent is removed. Contamination of the pitch or asphalt with even minor amounts of the less viscous, more creepy resins and oils degrade the quality of the pitch or asphalt.

SUMMARY OF THE INVENTION

The present invention provides for improved methods for separating resins and asphaltenes during an alkane deasphalting process. The use of phase separation accelerators as extraction aids during the deasphalting process reduces the entrainment of colloidal asphaltenes into the alkane and resin solution and the entrainment of the alkane solution into the separated asphaltenes.

DESCRIPTION OF THE PRIOR ART

U.S. Pat. Nos. 4,502,950 and 4,525,269 teach processes for deasphalting asphaltene-containing hydrocarbons using an amorphous silicon dioxide and/or silicate compound and a metal compound such as magnesium carbonate or oxide, or calcium carbonate or oxide, respectively, with a solvent selected from the group consisting of $C_3$ to $C_{20}$ aliphatic or alicyclic hydrocarbon; $C_1$ to $C_{10}$ saturated aliphatic and alicyclic monohydric alcohols; liquid hydrogen disulfide; and liquid carbon dioxide.

U.S. Pat. No. 4,810,367 teaches a two-stage deasphalting process using two solvents: a heavy solvent and a light solvent. In one instance, the first stage involves the separation of the asphaltene fraction with the heavy solvent and the second stage involves precipitation of the resin fraction with the light solvent. U.S. Pat. No. 3,830,732 describes a process using two solvents, propane and pentane, which requires two completely separate solvent recovery units.

DETAILED DESCRIPTION OF THE INVENTION

The present invention relates to methods for improving the separation of resins from asphaltenes during processing of a residuum feedstock in an alkane deasphalting unit comprising adding to the deasphalting unit a phase separation accelerator (PSA).

The residuum feedstock used in this invention typically include, but are not limited to, atmospheric tower bottoms, vacuum tower bottoms, crude oil, topped crude oils, coal oil extract, shale oils and tar sands oils.

The phase separation accelerators having utility in the present invention include, but are not limited to, alkyl and alkylaryl alkoxylates, alkylaryl sulfonates, and hetero-atom punctuated fatty polymers.

The alkyl and alkylaryl alkoxylates are selected from the group consisting of alkylphenols, alkylamines, alkylols, and alkyletherols with or without cross-linking with aldehydes, di- or multifunctional acids, epoxides, and isocyanates. Preferred alkyl groups contain 3–15 carbons and the alkoxyl groups have 2–3 carbons. These compounds are selected singly or in combinations such that the overall content of ethylene oxide (EO) present is between 8% and 80%, preferably between 16% and 40%.

Preferred alkyl or alkylaryl alkoxylates include, but are not limited to, poly(propylene glycol) ethoxylate, which is available as Pluronic® P-84 from BASF; poly(propylene glycol) ethoxylate crosslinked with diepoxide, such as Dissolvan® 3245, available from Hoechst; and polypropylene glycol ethoxylates and butyl/nonylphenol propoxyethoxylates crosslinked with formaldehyde crosslinked together with acrylic/maleic cooligomer, which is available commercially from Witco as Witbreak® DRI-9037.

The alkylphenol alkoxylates crosslinked with formaldehyde generally have molecular weights in the range from about 500 to about 5000 with a range of about 1000 to about 2500 preferred. The alkyl group may be linear or branched and have 3 to about 15 carbon atoms with a range of about 4 to about 9 preferred. The alkoxy group has about 2 to about 3 carbon atoms with 2 preferred. The alkoxylation comprises 20 to 80% by weight of the molecule with about 50% preferred.

Preferably, these crosslinked alkylphenol alkoxylates include, but are not limited to, nonylphenol ethoxylates and nonylphenol propoxyethoxylates crosslinked with formaldehyde using either acid or base catalysis, and mixtures thereof.

The alkylarylsulfonates useful in the present invention include the acids and the amine salts. These compounds include, but are not limited to, dodecylbenzene sulfonic acid (DDBSA) and its amine salts, particularly DDBSA alkanolamine salts. The dodecylbenzene sulfonic acid is commercially available as Witconate® 1298 soft (linear chain) acid or hard (branched chain) acid, from Witco Corporation. Alkanolamines are preferably selected from alkoxylated ammonia compounds, such as mono-, di-, and triethanolamine, and diethylene glycol amine, and their condensation products, such as morpholino and polyamine compounds, such as are available from Huntsman Chemical Company.

The hetero-atom punctuated fatty polymers are polymers having molecular weights of 1000 to 1,000,000 in which $C_{10}$–$C_{30}$ alkyl, alkenyl, or alkylene (i.e. "fatty") hydrocarbon groups are separated in some way (i.e. "punctuated") by hetero-atom (i.e. non-C or —H) containing groups such as ethers, esters, amides, amines, phenols, heterocycles, thio and halo carbons, and the like, which are smaller in size than the fatty groups in the same polymer.

The particular hetero-atom punctuated fatty polymers include, but are not limited to, alkylphenol formaldehyde condensates, poly(alkylacrylate or methacrylates), ethylene-vinylacetate (EVA) copolymers, dialkylfumerate-vinylacetate copolymers (DAFVA), and blends of these polymers.

Most preferably the hetero-atom punctuated fatty polymer is a blend of $C_{17}$ poly(ethylene)-vinylacetate $10^5$ MW copolymer and a di-$C_{22}$-alkylfumerate-vinylacetate $3\times10^4$ MW copolymer in a 2:1 ratio.

The operation of deasphalting units is well-known by those skilled in the art. Typically, they comprise a contacting zone, preferably a countercurrent contacting zone in which the hydrocarbon is contacted with a solvent. The extract, or supernatent, stream comprises the deasphalted oil and solvent, which exits the unit for further processing to separate the two. The operating conditions for the deasphalting unit are dependent, in part, upon the solvent utilized, the characteristics of the hydrocarbon feedstock, and the physical properties of the deasphalted oil or asphalt desired.

The alkane solvent employed in the deasphalting process include, for example, propane, methylpropane, ethylpropane, n-butane, methylbutane, n-pentane, n-hexane, 2,3-diethylhexane, n-heptane, 2,3,5-trimethylheptane, n-octane, 3-ethyl-5-butyloctane, n-nonane, n-decane, 3-butyl-6-methyldecane, n-dodecane, n-pentadecane, n-octadecane, and n-nonadecane. Propane, n-butane, n-heptane, n-pentane, and n-hexane are preferred with mixtures particularly preferred depending on processing conditions.

Neither too little nor too much of the phase separation accelerator (PSA) should be added to improve the separation of asphaltenes and resins from each other and the base residuum or oil. The optimum or effective amount will, of course, vary due to the type of crude oil residuum being processed, the type and amount of asphaltenes present in the system, the type and amount of alkane used, the temperature and pressure of the extraction process, and metal and salt content of the residuum, among other things. Preferably, from about 10 to 1000 parts of phase separation accelerator may be added per million parts of residuum. More preferably, this amount ranges from about 20 parts to about 100 parts of PSA per million parts residuum.

In the practice of the present invention, a standard alkane deasphalting process is employed. The starting hydrocarbon residuum is charged into an extraction tower (such as a baffle tower or rotary disc tower) at the top, while the alkane solvent is charged into the extraction tower at a portion near the bottom. The PSA's may be added at any point that is convenient to the process, such as directly to the extraction tower or upstream to either the residuum charge or to the solvent charge.

The PSA's may be added neat or in any solvent that is compatible with the crude oil residuum and include, but are not limited to, linear or branched chain aliphatic or aromatic solvents, naphtha, toluene, xylene, and the like.

The invention will now be described with respect to a number of examples which are only demonstrative of the invention and not limiting thereof.

EXAMPLES

Testing was performed on fluid from a Southwest refinery to simulate a Demex production unit. 20 mL of asphaltic residuum and 80 mL of heptane were poured into a 100 mL pressure rated cone bottom tube. The tube was heated to 225° F. The tube was shaken at 4 $s^{-1}$ for 1 minute in a mechanical shaker. The tube was allowed to settle for 5 minutes at 225° F. The top 70 mL of liquid was thiefed out and centrifuged for 30 minutes. The volume of asphaltene centrifuged to the bottom of the tube was recorded.

Table A defines the chemical treatments employed. Table I reports the results of the initial dose response.

TABLE A

| Treatment No. | Chemical Description |
|---|---|
| 1. | Dodecylbenzene sulfonic acid blended with ethanolamine condensate. |
| 2. | Dodecylbenzene sulfonic acid blended with nonylphenol ethoxylate crosslinked with formaldehyde. |
| 3. | Poly(propylene glycol) ethoxylate and butyl/nonylphenol propoxyethoxylate crosslinked with formaldehyde cross-linked together with acrylic/maleic cooligomer. |
| 4. | Poly(propylene glycol) ethoxylate blended with nonylphenol ethoxylate crosslinked with formaldehyde. |
| 5. | Nonylphenol ethoxylate crosslinked with formaldehyde using acid catalysis. |
| 6. | Nonylphenol propoxyethoxylate crosslinked with formaldehyde using acid catalysis. |
| 7. | Nonyphenol propoxyethoxylate crosslinked with formaldehyde using base catalysis. |
| 8. | Poly(propylene glycol) ethoxylate crosslinked with diepoxide. |

TABLE A-continued

| Treatment No. | Chemical Description |
|---|---|
| 9. | Nonylphenol ethoxylate crosslinked with formaldehyde blended with octyldecylamine ethoxylate, methyl quaternary chloride. |
| 10. | Ethylene-vinylacetate copolymer blended with dialkylfumerate-vinylacetate copolymer. |
| 11. | Linear dodecylbenzene sulfonic acid. |
| 12. | Poly(propylene glycol) ethoxylate. |
| 13. | Poly(dimethylsiloxane) 1 kst. |

TABLE I

Demex Unit Simulation Procedure
Southwest Refinery Resid
Initial Dose Response

| Treatment No. | Dosage, ppm Active | Asphaltenes in Top 70 mL |
|---|---|---|
| Blank | 0 | 0.75 mL |
| 8 | 6 | 0.75 |
| 8 | 12 | 0.35 |
| 8 | 23 | 0.25 |
| 8 | 47 | 0.35 |
| 8 | 94 | 0.40 |
| 8 | 188 | 0.35 |
| 8 | 375 | 0.35 |

These results demonstrate that effective improvement in separation was obtained with as little as 12 ppm active of the poly (propylene glycol) ethoxylate crosslinked with diepoxide.

Having determined the initial dosage parameters, further testing was performed to determine if other compounds had utility as separation enhancers. These results are reported in Table II.

TABLE II

Demex Unit Simulation Procedure
Southwest Refinery Resid
Initial Chemical Response

| Treatment No. | Dosage, ppm Active | Asphaltenes in Top 70 mL |
|---|---|---|
| Blank | 0 | 0.60 mL |
| 1 | 79 | 0.25 |
| 2 | 41 | 0.80 |
| 3 | 21 | 0.15 |
| 3 | 21 | 0.15 |
| 3 | 10 | 0.20 |
| 4 | 31 | 0.25 |
| 5 | 30 | 0.45 |
| 6 | 30 | 0.25 |
| 7 | 23 | 0.40 |
| 8 | 23 | 0.25 |
| 9 | 20 | 0.25 |
| 10 | 33 | 0.25 |
| 11 | 50 | 0.20 |
| 12 | 35 | 0.15 |
| 13 | 25 | 0.30 |
| 13 | 12.5 | 0.40 |

These results demonstrate that treatment numbers 3 and 12 were particularly effective at enhancing the separation of asphaltenes in the simulated alkane deasphalting process. Their dose responses are presented in Table III.

TABLE III

Demex Unit Simulation Procedure
Southwest Refinery Resid
Chemical Optimization

| Treatment No. | Dosage, ppm Active | Asphaltenes in Top 70 ml |
|---|---|---|
| Blank | 0 | 0.60 mL |
| 3 | 21 | 0.15 |
| 3 | 41 | 0.15 |
| 3 | 82 | 0.15 |
| 12 | 17 | 0.40 |
| 12 | 35 | 0.20 |
| 12 | 70 | 0.20 |
| 12 | 140 | 0.30 |

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus defined the invention, what I claim is:

1. A method for improving the separation of resins from asphaltenes and from a base residuum feedstock during processing in an alkane deasphalting unit comprising adding to said unit an effective amount of a phase separation accelerator selected from the group consisting of alkoxylates of alkylphenols, alkylamines, alkylols, and alkyletherols; alkylarylsulfonates; and hetero-atom punctuated fatty polymers.

2. The method as claimed in claim 1 wherein said alkoxylates are cross-linked with aldehydes, di- or multifunctional acids, epoxides and isocyanates.

3. The method as claimed in claim 2 wherein said alkoxylates are selected from the group consisting of poly (propylene glycol) ethoxylates and butyl/nonylphenol propoxyethoxylates crosslinked with formaldehyde crosslinked together with acrylic/maleic cooligomer; poly (propylene glycol) ethoxylates; and poly(propylene glycol) ethoxylates crosslinked with diepoxide.

4. The method as claimed in claim 2 wherein said alkylphenol alkoxylates are crosslinked with formaldehyde to a molecular weight in the range of about 500 to about 5000.

5. The method as claimed in claim 4 wherein said alkyl group is linear or branched and has from about 3 to about 15 carbon atoms.

6. The method as claimed in claim 4 wherein said alkoxy has from 2 to about 3 carbon atoms.

7. The method as claimed in claim 4 wherein the alkoxylation comprises 20% to 80% by weight of said alkoxylates.

8. The method as claimed in claim 4 wherein said alkylphenol alkoxylates crosslinked with formaldehyde are selected from the group consisting of nonylphenol ethoxylates crosslinked with formaldehyde using acid catalysis; nonylphenol propoxyethoxylates crosslinked with formaldehyde using acid catalysis; nonylphenol propoxyethoxylates crosslinked with formaldehyde using base catalysis; and mixtures thereof.

9. The method as claimed in claim 1 wherein said hetero-atom punctuated fatty polymer is a $C_{10}$ to $C_{30}$ alkyl, alkenyl, or alkylene polymer having a molecular weight of from 1000 to 1,000,000 wherein said alkyl, alkenyl, or alkylene groups are separated by smaller hetero-atom containing groups.

10. The method as claimed in claim 9 wherein said hetero-atom punctuated polymer is selected from the group consisting of alkylphenol-formaldehyde condensates; polyalkylacrylates or methacrylates; ethylene-vinylacetate copolymers; dialkylfumerate-vinylacetate copolymers; and blends thereof.

11. The method as claimed in claim 10 wherein said blend comprises $C_{17}$ poly(ethylene-vinylacetate) with $10^5$ MW and poly(di-$C_{22}$-alkylfumerate-vinylacetate) with $3\times10^4$ MW in a 2:1 ratio.

12. The method as claimed in claim 1 wherein said alkylarylsulfonate is selected from the group consisting of dodecylbenzene sulfonic acid, and its amine or alkanolamine salts.

13. The method as claimed in claim 12 wherein said alkanolamines are selected from the group consisting of alkoxylated ammonia compounds and their condensation products.

14. The method as claimed in claim 1 wherein said phase separation accelerator is added to said unit in an amount ranging from about 10 parts to about 1000 parts per million parts residuum.

15. The method as claimed in claim 1 wherein said phase separation accelerator is added directly upstream of said unit.

* * * * *